United States Patent [19]

Butler

[11] 4,230,107

[45] Oct. 28, 1980

[54] RAIL SYSTEM AND GAS METERING SYSTEM IN A HYPERBARIC SYSTEM

[75] Inventor: Glenn J. Butler, White Plains, N.Y.

[73] Assignee: IUC International, Inc., Bronx, N.Y.

[21] Appl. No.: 892,808

[22] Filed: Apr. 3, 1978

[51] Int. Cl.[3] ..... A61M 16/02

[52] U.S. Cl. ..... 128/205.26; 128/30

[58] Field of Search ..... 405/185, 193; 211/162; 104/89, 91, 93, 336, 335, 314, 315, 321, 323; 269/322, 46; 128/1 R, 1 B, 205.26, 204, 142.3; 244/118 P, 137 P

[56] References Cited

U.S. PATENT DOCUMENTS

| | | | |
|---|---|---|---|
| 1,834,580 | 12/1931 | Drinker et al. | 128/204 |
| 2,920,581 | 1/1960 | Cook et al. | 104/93 |
| 3,323,312 | 6/1967 | Banjavich | 405/193 |
| 3,754,551 | 8/1973 | Nielsen | 128/204 |
| 3,780,663 | 12/1973 | Pettit | 104/91 X |
| 3,877,427 | 4/1975 | Alexeev et al. | 128/204 |
| 3,999,630 | 12/1976 | McPhee | 244/118 P |
| 4,011,867 | 3/1977 | Arntzen | 128/204 |

FOREIGN PATENT DOCUMENTS

| | | | |
|---|---|---|---|
| 926086 | 3/1955 | Fed. Rep. of Germany | 128/30 |
| 555615 | 1/1957 | Italy | 128/30 |
| 907524 | 10/1962 | United Kingdom | 128/204 |
| 395091 | 12/1973 | U.S.S.R. | 128/204 |

OTHER PUBLICATIONS

Feder, *Offshore,* May 1975.

*Primary Examiner*—Henry J. Recla
*Attorney, Agent, or Firm*—William F. Lawrence

[57] ABSTRACT

A rail system in a hyperbaric transfer system which has particular utility in transferring injured divers from an offshore decompression chamber to an onshore hyperbaric facility. Also disclosed is a gas metering system which has particular utility in supplying oxygen to an emergency transfer vessel.

16 Claims, 6 Drawing Figures

RAIL SYSTEM AND GAS METERING SYSTEM IN A HYPERBARIC SYSTEM

BACKGROUND OF THE INVENTION

The invention relates to a rail system and a gas metering system utilized in a hyperbaric transfer system. Such a hyperbaric transfer system has been developed by Mr. Andre Galerne and is the subject of a related copending application, Ser. No. 892,867 filed concurrently herewith. The disclosure of the Galerne application is hereby incorporated by reference.

Offshore diving operations have brought tremendous problems to divers who are called upon to perform heavy construction work at depths and in diving conditions that border on the limits of underwater technology. The risk of serious trauma exists and with the use of saturation techniques there is a danger of acute illness while the diver is under pressure.

Divers who work at great depths for considerable amounts of time must undergo decompression for periods up to two weeks. Normally, the decomposition takes place in a conventional decompression chamber on the offshore rig. However, in rig abandonment situations or in situations in which a diver is seriously injured, it may be necessary or desireable to leave the offshore decompression chamber.

The system described in the copending Galerne application is a system for transferring the divers undergoing decompression from the offshore rig to another hyperbaric facility.

However, since the vessels of the hyperbaric transfer system are relatively small in comparison to conventional decompression chambers and hyperbaric facilities, the hatch openings also are relatively small. A diver being transferred is often incapacitated and must be assisted when being moved in and out of the transfer vessels. Due to the small opening size, which can be 25 to 30 inches at its widest point, as well as the limited space within the hyperbaric transfer vessels, the transfer of an injured diver between chambers can be difficult and dangerous. Transferring the injured diver through such a small opening can cause unnecessary disruption of the patient. For instance, if the patient has a broken limb, the limb should be completely immobilized. Transfer of the patient between chambers could easily disrupt the limb and cause additional injury. Even if the injured diver can be transferred into and out of the transfer vessel without disrupting his condition, the transfer is slow and ordinarily requires more than one person to effect the transfer safely. In some situations, there only may be one person available to aid in the transfer.

Once the divers are inside the vessels of the transfer system, their condition must be kept stable. In keeping with this objective, the problem arises of keeping the gas mixtures constant within the vessels of the transfer system. This includes both the pressures and concentrations of the compression gas, the breathing gas and the oxygen within the chamber. It is especially true for the oxygen supply within the vessel which must be replenished as it is used. Until now, the oxygen could be regulated by feeding oxygen into the vessel and providing the vessel with an oxygen analyzer which would measure the gas concentration within the vessel. Similar analyzers and meters could be provided for compression or breathing gas mixtures. However, the process of feeding gas into the chamber, waiting for the pressure or concentration within the vessel to stabilize and reading the analyzer is slow and requires the complete attention of the individual performing the operation. In an emergency situation, such as a fire on the offshore rig, the time necessary to take an accurate measurement is not available. The persons moving the vessel have all they can do just moving the vessel or removing the vessel from the offshore rig. Furthermore, in an emergency situation, there is no assurance that personnel capable of accurately metering gas into the vessel and reading the analyzer will be available.

SUMMARY

The present invention which relates to a rail system for transferring an injured diver into and out of the vessels of a hyperbaric transfer system and gas metering system for accurately dispensing a gas into the vessels of a hyperbaric transfer system solves these problems. In an emergency situation, an injured diver can be transferred quickly, safely and with a minimum amount of assistance from a conventional decompression chamber into a vessel of a hyperbaric transfer system and from a vessel to another hyperbaric facility. Furthermore, once the diver is inside a vessel of the hyperbaric transfer system, the gas supply to the vessel can be maintained at a constant level without the time consuming necessity of carefully metering gas directly into the vessel and analyzing the gas content of the chamber.

One general object of the rail system, therefore, is to provide a new and improved system for transferring an individual between hyperbaric chambers.

More specifically, an object of the rail system is to provide a system for transferring an individual from an offshore decompression chamber into a vessel of a hyperbaric transfer system and from the vessel into an onshore hyperbaric facility.

Another object of the rail system is to provide a system which is capable of transferring an injured individual through small hatch openings in hyperbaric chambers without unnecessary disruption of the individual.

A further object of the rail system is to provide a system to transfer the individual quickly, safely and with a minimum amount of assistance.

One general object of the gas metering system, is to provide a new and improved system for metering gas into a chamber.

More specifically, an object of the gas metering system is to provide a system for metering oxygen, decompression gas, or breathing gas into a hyperbaric vessel in a hyperbaric transfer system.

Another object of the gas metering system is to provide a system for feeding gas into a hyperbaric chamber quickly and accurately but without the necessity of utilizing sophisticated gas analyzing equipment.

In one illustrative embodiment of the invention there is a transfer system which includes two chambers. The first chamber is lightweight and manually transportable. The first chamber, called a transfer chamber is mated with a conventional decompression chamber and pressurized. A frame slideably mounted in the transfer vessel is pulled partially out of the transfer vessel and into the decompression chamber. An injured diver on a stretcher is placed on a supporting frame, and the frame with the stretcher is slid back into the transfer vessel. The transfer vessel is sealed and transported to a larger second chamber called a helicopter chamber. During transportation to the second chamber, the gas supply in the transfer vessel is kept constant by the gas metering system. In one embodiment, the gas metering system includes a gas tank from which gas is metered into a small cannister of known volume. In turn, the gas in the small cannister is metered into the transfer chamber. The transfer vessel is mated with the helicopter chamber and the frame is slid partially out of the transfer chamber so that it extends into the helicopter chamber. An attendant already in the helicopter chamber, uses the rail system to transfer the injured diver on the stretcher into the helicopter chamber. In one embodiment, the rail system includes a supporting structure mounted on the inside surface of the helicopter chamber and a hanging structure for slidably hanging the stretcher on the supporting structure. By attaching the hanging structure to the stretcher, the stretcher can be pulled from the transfer chamber into the helicopter chamber by the attendant without disturbing the injured diver. At the same time the supporting structure supports the weight of the stretcher and injured diver allowing a single attendant to accomplish the transfer.

The helicopter chamber can then be sealed and transported by helicopter or another expedient means to an onshore hyperbaric facility. Once at the facility the helicopter chamber is mated with the hyperbaric facility and the stretcher and diver are transferred into the hyperbaric facility. In one embodiment of the invention, the stretcher and diver are transferred to the hyperbaric facility utilizing a rail system. As in the helicopter chamber, the hyperbaric facility has a supporting structure mounted on the inside surface of the helicopter chamber and a hanging structure for slidably hanging the stretcher on the supporting structure. The supporting structure extends through the hatch openings of the hyperbaric facility and helicopter chamber and into the helicopter chamber. By attaching the hanging structure to the stretcher, the stretcher can be pulled through the hatch openings and into the hyperbaric facility.

In accordance with another feature of the invention, the supporting structure is a solid cylindrical rod and the hanging structure is a U-shaped cup or hanger which fits around the rod and slides along the length of the rod. Preferably, the hanging structure is a U-shaped bearing cup with a channel shaped bearing race within. Attached to the cup is a ring through which a wire is passed. The two ends of wire are attached to and support the two corners at the head of the stretcher. A second hanging structure is attached to and support the two corners at the foot of the stretcher.

In another particular arrangement the supporting structure is a channel shaped rail and the hanging structure fits and slides within the channel along the length of the rail. Preferably, the hanging structure includes a ball shaped fitting which fits within the channel. The ball-shaped fitting and channel cooperate with a ball bearing race for slidable movement of the fitting.

The foregoing and other objects, features and advantages of the invention will be more readily understood from the following description of certain preferred embodiments when read with the accompanying drawings.

BRIEF DESCRIPTION OF THE DRAWINGS

Referring to FIGS. 1 and 2, a transfer chamber 13 is mated with a conventional decompression chamber 11.

The decompression chamber 13 is generally spherically shaped and has a short tubular projection 14 which defines a doorway 16. The outer end of projection 14 is provided with a flange 149 which has a flat outer surface which permits it to be mated with flange 18 of the transfer vessel 13. The flange 18 has a flat outer face 56 with an elliptical opening 12 formed therein. The long dimension of the elliptical opening is smaller than the inner diameter of cylindrical vessel 13. As shown in FIG. 1, the flanges 18 and 149 are coupled in a fluid tight relationship with an annular shaped clamp-type coupling 15. The transfer vessel 13 is generally cylindrical in shape with a longitudinal horizontal axis and an access hatch opening 12. The transfer vessel 13 is removeably mounted on a rectangular base 20.

Referring to FIGS. 3 and 3*a*, a schematic view of a gas metering system is illustrated. An oxygen tank is secured with spring clips 129 to the top of the transfer vessel 13 next to a control box 29. The tank 33 is cylindrical in shape. Secured inside the control box 29 is a three-way ball valve 131 which controls the output of the oxygen tank 33. The first port 135 of the valve 131 is connected to the oxygen tank 33 with a hose 31. The second port 137 of the three-way valve is connected to a small cylindrical cannister 133 and the third port 139 is connected to the transfer vessel 13 through a hull penetrator 30 inside the control box. The transfer chamber has a check valve 141 attached to the inside portion of the hull penetrator 30. The check valve is installed to prevent loss of gas from within the vessel 13.

Referring to FIGS. 1, 2 and 3, the transfer chamber 13 has a C-shaped brace 143 welded to the interior sides of the transfer vessel 13 along the length of the vessel 13. Within the brace 143, as shown in FIG. 2, stretcher 44 is supported by a stretcher supporting frame 145. The frame 145 has two straight longitudinal sides 147 and four bowed cross members 151 connecting the sides 147. The longitudinal sides 147 are channel shaped with the open ends of the channel shaped sides 147 facing the interior of the vessel 13. The bow-shaped cross members 151 curve down into the bottom of the vessel 13 and form a supportive frame. Each channel shaped side 147 has two wheels 153 rotatably mounted thereon by a post and bearing 155. Two wheels 153 are mounted on each side 147 of the frame 145 so that one wheel is at the end of the side 145 closest to the rear of vessel 13 and one is mounted at a point about midway between the end of the vessel 13 and the opening 12. The wheels 153 which are attached to the sides 147 of the frame 145 fit within the C-shaped brace 143 so that the frame 145 can slide in longitudinally in the vessel 13. The frame 145 with the attached wheels 153 is wider than the elliptical opening 12. However, the elliptical opening is wider than the width of the frame 145.

Figure 1:
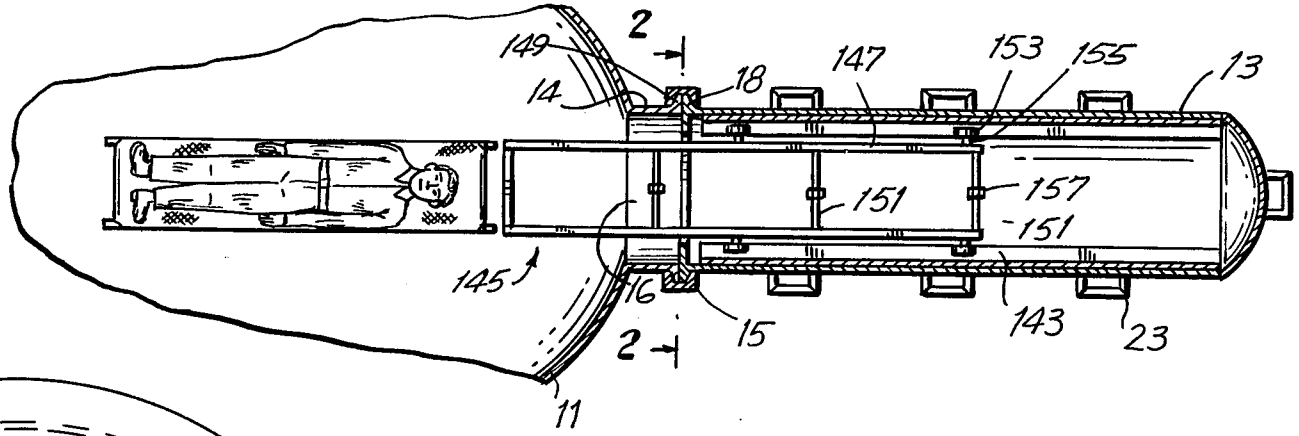
FIG. 1 is an elevated cross-sectional view of the transfer vessel mated with a conventional decompression chamber showing an injured diver on a stretcher being transferred from the offshore decompression chamber into the transfer vessel.

The cross members 151 have a joint 157 which is collapsable and allows the two sides 147 and wheels 153 to be removed from the C-shaped brace 143 whereupon the frame and wheels can be removed from the vessel 13 through the elliptical opening 12.

Figure 3:
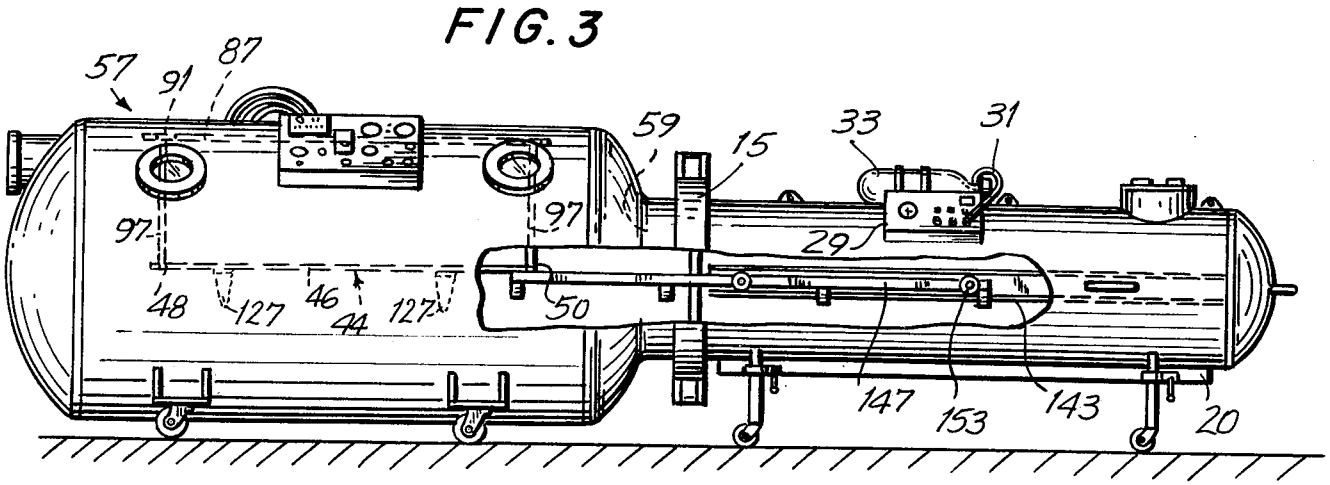
FIG. 3 is a side view of the transfer vessel mated with the helicopter chamber.

Referring to FIGS. 1 and 3, the transfer chamber 13 is shown mated with the helicopter chamber 57. The helicopter chamber is generally cylindrical in shape with a longitudinal horizontal axis and an access aperture 59 at one end of the chamber 57. Around the access aperture 59 is a flanged rim 61 having a flat outer surface which is mated with the transfer chamber 13 using the annular shaped coupling 15. The helicopter chamber is provided with various life-support systems described in the aforementioned Galerne application.

Figure 4:
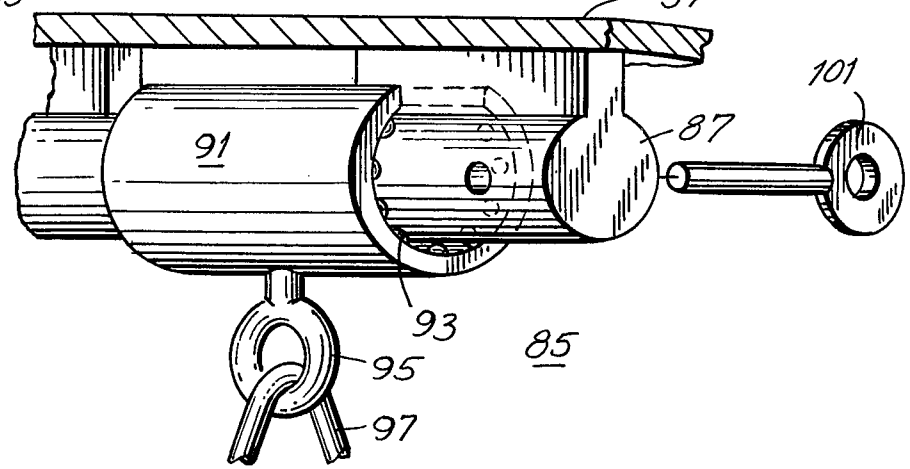
FIG. 4 is a front perspective view of the rail system for the transfer system.

Referring to FIGS. 3 and 4, inside the chamber 57, a linear race ball bearing system 85 supports the stretcher 44, together with brackets 127 which are mounted on the inside wall of the vessel 13. The stretcher 44 is rectangular in shape and has a tubular frame 46 around its edge. A solid cylindrical rail 87 is mounted longitudinally along the length of the ceiling of the chamber 57. A U-shaped bearing cup or hanger 91 having within it a U-shaped linear bearing race 93 fits snugly around the rail 87 and slides longitudinally along the length of the rail 87. A ring 95 is attached to the bottom of the cup 91. A wire 97 is passed through the hole in the ring 95 and each of the two ends of the wire are attached to each corner of the frame 46 at the head 48 of the stretcher 44. A second bearing cup and bearing race are mounted on the rail 87. The second bearing cup also has a ring through which a wire is passed. The two ends of the wire are attached to each corner of the foot 50 of the stretcher 44. A disconnect pin 101 passes through a hole 99 in each end of the rail 85. The disconnect pin 101 is ring shaped with a tubular projection which fits snugly into hole 99.

Figure 5:
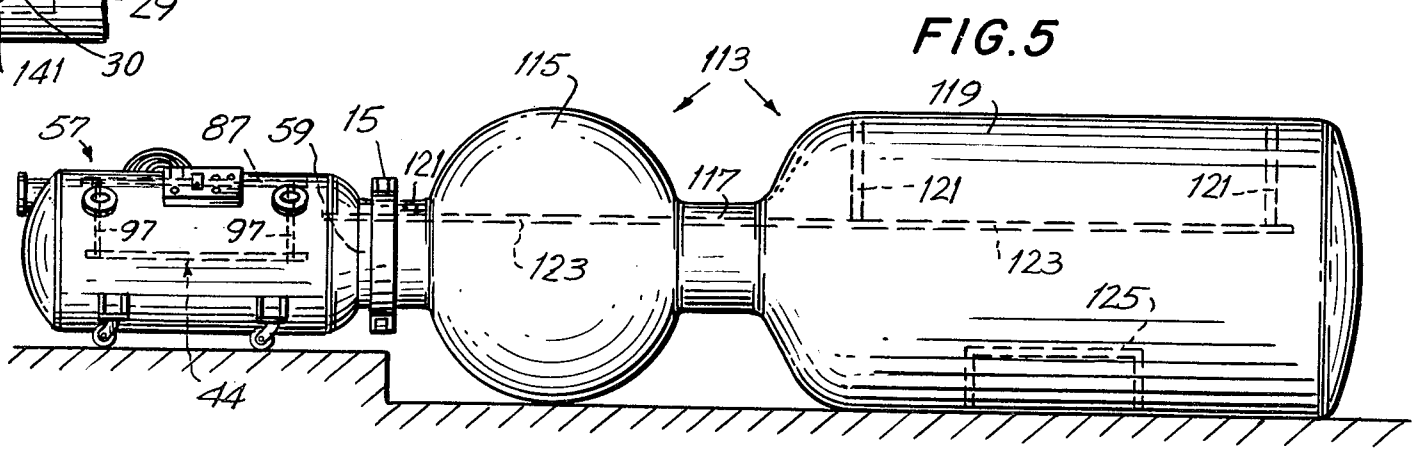
FIG. 5 is a side elevational view of the helicopter chamber mated with the onshore hyperbaric facility.
Figure 3A:
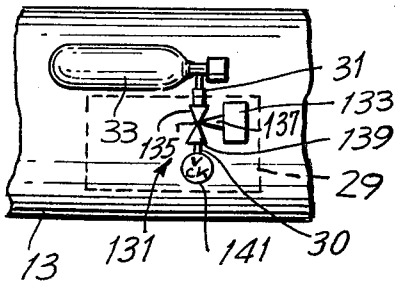
FIG. 3*a* is a schematic view of the gas metering system utilized in the transfer chamber.

Referring to FIG. 5, the helicopter chamber 57 is shown mated with an onshore hyperbaric facility 113.

The helicopter chamber 57 having the stretcher 44 hanging therein on a linear race ball bearing system 85, shown in detail in FIG. 4, is mated with the entry lock 115 of the onshore hyperbaric facility. The annular clamp coupling 15 seals the helicopter chamber 57 and the entry lock 115. At one end of the entry lock 115 which is generally spherical in shape is a flange with a circular opening (not visible in FIG. 7) which mates with the flanged rim and aperture 59 of the helicopter chamber 57. The other end of the entry lock 115 has a cylindrical passageway 117 which mates with the entry lock 115 with the main lock 119 of the hyperbaric facility 113. The main lock 119 is essentially cylindrical in shape and has a longitudinal axis. Attached to the ceiling of the main lock 119 are two supporting brackets 121. Another supporting bracket 121 is attached to the ceiling in the entry lock 115. The three supporting brackets 121 support a cylindrical rod 123 identical in construction to rail 87. The rod 123 extends longitudinally from the rear of the main lock 119, through the passageway 117, through the entry lock 115, through the aperture 59 and into the helicopter chamber 57. Inside the main lock 119 is a treatment table 125.

In use, as shown in FIG. 1, the transfer vessel 13 is mated to a conventional decompression chamber 11 with a conventional clamp-type coupling 15 thereby allowing the individuals in the chamber 11 to be transferred into the transfer vessel 13. Although the breathing gas supply, the oxygen supply and the compression gas supply can be provided from the same system that supplies the decompression chamber 11, oxygen is supplied to the transfer vessel 13 from a tank 33 mounted on the top of the transfer vessel 13 next to the control box 29. The arrangement is shown in FIGS. 3 and **3*a*. The tank 33 is connected with a hose 31 to a conventional three-way ball valve 131 inside the control box 29. One port 135 is connected to the tank 33. A second port 137 is connected to a small cannister 133 having a volume of one-tenthousandth of the volume of the transfer vessel 13. The third port 139 is connected through a penetrator 30 to the transfer vessel 13. By turning the valve stem on the valve 131 so that the valve is opened between the tank 33 and the cannister 133, the cannister 133 is filled with oxygen. By turning the valve stem so that the valve is opened between the cannister 133 and the transfer vessel 13, the oxygen in the cannister 133 is released into the transfer vessel 13. The check valve 141 mounted on the inside of the penetrator 30 prevents the gas in the vessel 13 from escaping out of vessel 13 but permits the oxygen to pass into the vessel. The pressure of the oxygen in the tank 33 is greater than the pressure within the transfer vessel 13 so the oxygen can be added to the transfer vessel 13**.

By providing a cannister 133 which is a known volume, an exact volume of gas can be metered into the transfer vessel 13. Of course, the system can also be used to meter breathing gas or compressing gas into the transfer vessel 13.

Upon transferring the individuals into the transfer vessel 13, the transfer vessel can be transported to be mated with the helicopter chamber 57 (as shown in FIG. 3). During the period when the transfer vessel 13 is being transported, the oxygen metering system allows a precise amount of oxygen into the vessel 13 quickly and without the use of oxygen analyzers. Therefore, by simply counting the number of times the cannister 133 is filled and dispensed into the transfer vessel 13, an exact volume of oxygen may be added to the transfer vessel to replace the oxygen consumed by the occupants of the transfer vessel 13.

Figure 2:
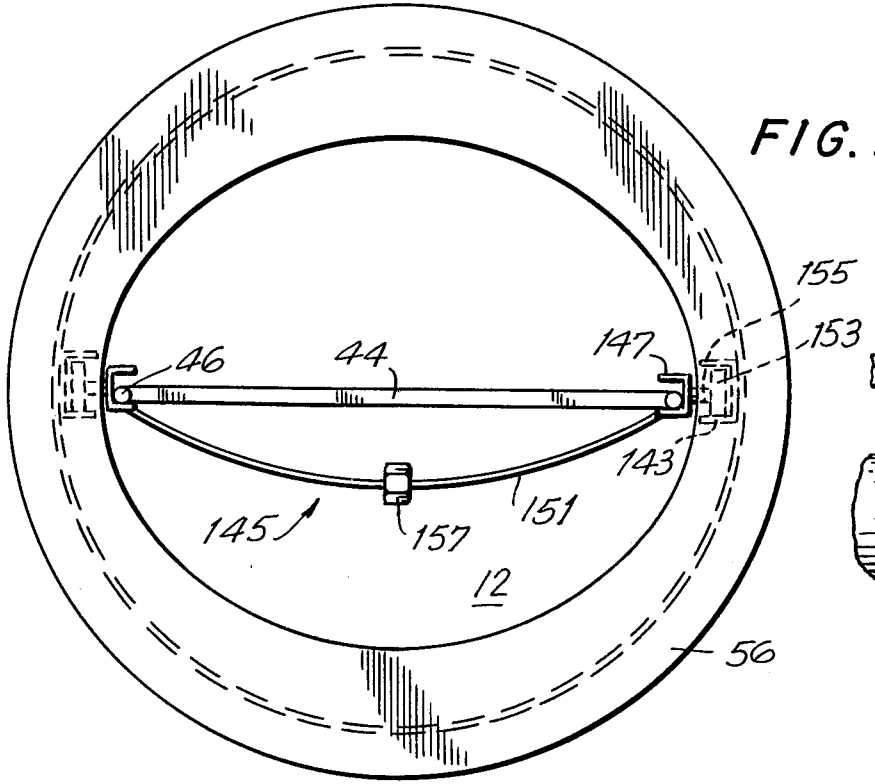
FIG. 2 is a cross-sectional view of the transfer vessel with the stretcher within the transfer vessel along the lines 2—2 in FIG. 1.

Referring to FIGS. 1 and 2, if there is an injured diver in the decompression chamber 11, he is placed on a stretcher 44. The stretcher supporting frame 145 can be pulled partially out of the vessel 13 so it extends into the decompression chamber 11. The frame 145 is slidably mounted on wheels 153 within the C-shaped brace 143. The frame 145 is pulled into the chamber 11, to a point where the wheels 153 abut against the inside of the flat surface of the flange 18. At this time, the stretcher 44 with the injured diver can be placed on the frame 145. The stretcher 44 and frame 145 are then pushed back into the transfer vessel 13.

The transfer vessel 13 is sealed by replacing its hatch and transported to and mated with the helicopter chamber 57.

The diver and stretcher 44 are transferred into the helicopter chamber 57 by using a linear race ball bearing system 85 shown in detail in FIG. 4. A particular unit which can be used in this system is a linear race ball bearing unit made by Thompson Bearing Co. of Manhasset, N.Y. In its preferred form, a solid cylindrical rail 87 is mounted longitudinally on the inside of helicopter chamber 21. The head 48 of stretcher 44 is provided with a wire 97 connecting the two corners of the head of the stretcher to a ring 95 on the bearing cup 91. The wire 97 can also be a cable, rope, chain or the like. The bearing cup 91 with channel shaped bearing race 93 within is slidably mounted on the rail 87 by the attendant, already in the helicopter chamber 57. The ball bearings in the race 93 support the weight of the head of the stretcher 44 but also allow movement longitudinally along the rail into the helicopter chamber 57. The ends of a second wire 97 which pass through a ring 95 of a bearing cup 91 having a bearing race therein are attached to the foot 50 of the stretcher 44 and after pulling the stretcher 44 partially into the helicopter chamber 57, the second ball bearing race system 85 can be attached to the rail 87. Thus, the stretcher 44 can be pulled into the helicopter chamber 57 until the head of the stretcher 44 abuts the inside wall of the helicopter chamber 57. The cup and race are kept on the rail by inserting a disconnect pin 101 into each hole 99 on each end of the rail 87. After the stretcher 44 is inside the helicopter chamber 57 and secured by inserting the disconnect pins 101, two support brackets 127, which are attached to the inside of the chamber 57, are raised to suppport the weight of the stretcher 44. The brackets are also held in position by disconnect pins. At this point, the disconnect pins 101 in the rail 87 can be removed and each cup and race can be removed from each end of the rail 87. The helicopter chamber 57 is then sealed and can be transported to an onshore hyperbaric facility.

Referring to FIG. 5, upon arrival at another hyperbaric facility 113, the helicopter chamber 57 is removed, brought into the facility and mated with the entry lock 115 of the hyperbaric facility 113 using a clamp-type coupling 15. Again the pressure in the hyperbaric facility 113 is made equal to the pressure in the helicopter chamber 57 and the access door 69 (not shown) is removed. The divers are then transferred into the main lock 119 of the hyperbaric facility 113 by passing through the entry lock 115 and passageway 117.

When there is an injured diver who must be carried out of the helicopter chamber 57 through the entry lock 115 and into the main lock 119, the linear race ball bearing system 85 (as shown in FIG. 4) is utilized to make the transfer.

A rod 123 bracketed to the top of facility 113, is extended through the entry lock 115 into the helicopter chamber 57. The rod 123 can be preferably a telescoping rod or it can be in a few separate sections which can be easily and quickly hung longitudinally on the ceiling of the hyperbaric facility 113.

In its preferred form, the rod 123 is a solid cylindrical rod of the same type as rail 87.

In order to transfer the stretcher 44 from the helicopter chamber 57 each cup 91 and race 93 at the head and foot of the stretcher 44 is reattached to the rail 87 by the attendant in the helicopter chamber 57. The rod 123 projects into the helicopter chamber 57. The stretcher 44 is pushed forward until the cup and race at the foot 50 of the stretcher 44 is at the end of the rail 87 at which time it is removed from the rail 87 and slid onto rod 123. The stretcher 44 is pushed forward towards the entry lock 115 until the cup and race at the head 48 of the stretcher 44 is at the end of the rail 87. The cup and race at the head of the stretcher is then removed from the rail 87 and slid onto the rod 123. The stretcher 44, now completely supported by the rod 123, can be pulled through the entry lock 115 and into the main lock 119 within a few inches of a treatment table 125. At this point, attendants can disconnect the wires 97 and the injured diver can be transferred from the stretcher 44 to the table 125 using conventional bed-changing techniques.

The sliding rail system 85 serves the complete purpose of safely transferring a severely injured diver from the transfer vessel 13 into the helicopter chamber 57 and from the helicopter chamber to the hyperbaric facility 113. The system uses a minimal amount of structure thereby saving space in the already crowded chambers. Also the rail system allows the injured diver to be transferred easily through the hatch openings in the chambers. Without such a rail system, it would be very difficult for a single attendant inside helicopter chamber 57 to maneuver the injured diver in and out of the hatch opening. Additionally, the rail system allows the injured diver to be transferred into the main lock 119 of the hyperbaric facility 113 in a matter of seconds. The seconds saved using the rail system could save the diver's life.

The terms and expressions which have been employed are terms of description and not of limitation, and there is no intention in the use of such terms and expressions of excluding any equivalents of the features shown and described or portions thereof, but it is recognized that various modificiations are possible within the scope of the invention claimed.

What is claimed is:

1. A hyperbaric system comprising a hyperbaric chamber having an inside surface;

a stretcher within said chamber;

a means for hanging said stretcher in a substantially horizontal plane in said chamber, said means comprising a supporting structure transversely mounted on said inside surface substantially above said stretcher and hanging means attached to said stretcher and connected with said supporting structure and extending downwardly from said supporting structure to permit slidable movement of said hanging means and therefore of said stretcher along said supporting structure whereby said hanging means does not obstruct the sides and undersides of said stretcher.

2. The hyperbaric system as claimed in claim 1, wherein said chamber has an access aperture and said supporting structure has two ends, one of said ends being adjacent to said access aperture.

3. The hyperbaric system as claimed in claim 2, wherein said supporting structure has a longitudinal channel therein, said supporting structure being mounted so that the open end of said channel is not abutting said inside surface of said chamber; and said means for slidably hanging said stretcher is mounted within said channel to permit movement along the length of said supporting structure.

4. The hyperbaric system as claimed in claim 1, wherein said supporting structure includes a cylindrical rod, said rod being mounted on the inside surface of said chamber.

5. The hyperbaric system as claimed in claim 4, wherein said hanging means includes a U-shaped hanger slidably mounted on said rod and a supporting means attaching said hanger to said stretcher for supporting the stretcher in a substantially horizontal plane in said chamber when the hanger is mounted on said rod.

6. A hyperbaric system comprising a hyperbaric chamber having an inside surface;

a stretcher within said chamber;

a cylindrical rod transversely mounted on the inside surface of said chamber substantially above said stretcher;

a U-shaped hanger;

means for mounting said hanger on said rod including a roller bearing means connecting said U-shaped hanger and said rod to permit low-friction movement of said hanger along the length of said rod; and supporting means securing said hanger to said stretcher and extending downwardly from said hanger for supporting the stretcher in a substantially horizontal plane in said chamber when the hanger is mounted on said rod whereby said hanging means does not obstruct the sides and undersides of said stretcher.

7. A hyperbaric system comprising a hyperbaric chamber having an inside surface;

a stretcher within said chamber;

a cylindrical rod mounted on the inside surface of said chamber;

a U-shaped hanger having a ball bearing race mounted within said U-shape and connected to said hanger, said U-shaped hanger being mounted on said rod to permit reciprocating movement of said hanger along the length of said rod;

a supporting means securing said hanger to said stretcher for supporting said stretcher in a substantially horizontal plane in said chamber when the hanger is mounted on the rod.

8. The hyperbaric system, as claimed in claim 7, wherein said supporting means includes a wire connecting said hanger to said stretcher for supporting said stretcher in a substantially horizontal plane in said chamber when said hanger is mounted on said rod.

9. A hyperbaric system comprising a hyperbaric chamber having an inside surface;

a stretcher within said chamber, said stretcher being substantially rectangular in shape, the two shorter dimensions of said rectangular shape defining the head and foot of the stretcher;

a cylindrical rod mounted on the inside surface of said chamber;

first and second U-shaped hangers, each hanger having a ball bearing race mounted within said U-shape and connected to said hanger, said U-shaped hanger being removably mounted on said rod to permit reciprocating movement of said hanger along the length of said rod;

first and second supporting means, said first supporting means securing said first hanger to said head of said stretcher and said second supporting means securing said second hanger to said foot of said stretcher, said first and second supporting means supporting said stretcher in substantially a horizontal plane when said first and second hangers are mounted on said rod.

10. A hyperbaric system, comprising a hyperbaric chamber having an inside surface;

a stretcher within said chamber;

a rail having a channel therein, said rail transversely mounted on the inside surface of said chamber substantially above said stretcher so that said channel does not abut said inside surface;

hanging means slidably mounted within said channel and attached to said stretcher and extending downwardly from said rail for hanging said stretcher on said rail in a substantially horizontal plane in said chamber; and a roller bearing means connecting said channel in said rail and said hanging means to permit low-friction movement of said hanging means along the length of said rail whereby said hanging means does not obstruct the sides and undersides of said stretcher.

11. The hyperbaric system, as claimed in claim 10, wherein said hanging means includes a ball slidably mounted within the channel in said rail; and supporting means connecting said ball to said stretcher for supporting said stretcher in a substantially horizontal plane when said ball is mounted in said channel in said rail.

12. A hyperbaric system comprising a hyperbaric chamber having an inside surface;

a stretcher within said chamber;

a rail having a channel therein, said rail transversely mounted on the inside surface of said chamber substantially above said stretcher so that said channel does not abut said inside surface, said channel having a channel-shaped bearing race mounted therein along substantially the entire length of said channel;

a ball slidably mounted within said channel shaped bearing race to allow reciprocating movement along the length of said rail by said ball;

a wire connecting said ball to said stretcher and extending downwardly from said ball, to support said stretcher in a substantially horizontal plane when the ball is mounted within said channel-shaped bearing race;

whereby said wire does not obstruct the sides and undersides of said stretcher.

13. A hyperbaric system comprising in combination a first hyperbaric chamber having an access aperture and a first inside surface;

a second hyperbaric chamber having an access opening and a second inside surface;

means for coupling said aperture and opening in a fluid tight relationship;

a stretcher within said first chamber; and means for transferring said stretcher from said first to said second chamber, said means including a supporting structure mounted longitudinally on said second inside surface and extending into said first chamber and hanging means connecting said stretcher to said supporting structure, said hanging means being slidably and removably mounted on said supporting structure for movement along the length of said supporting structure and for supporting said stretcher in a substantially horizontal plane whereby sliding the hanging means along the length of the supporting structure permits reciprocating movement of said stretcher between said first and second chamber.

14. A hyperbaric transfer system comprising in combination a first hyperbaric chamber having an access aperture and a first inside surface;

a second hyperbaric chamber having an access opening and a second inside surface;

means for coupling said aperture and said opening in a fluid tight relationship;

a stretcher within said first chamber;

means for mounting said stretcher in a substantially horizontal plane in said chamber, said mounting means comprising a first supporting structure mounted on said first inside surface and hanging means connecting said stretcher to said first supporting structure, said hanging means being slidably and removably mounted on said first supporting structure to permit slidable movement of said hanging means and therefore of said stretcher along the length of said supporting structure; and means for transferring said stretcher between said first and second chamber, said transferring means including a second supporting structure mounted longitudinally on said second inside surface and extending to a point substantially adjacent to said first supporting structure, said second supporting structure being adapted to receive said hanging means from said first supporting structure whereby said hanging means and therefore said stretcher can slide along the length of said first supporting structure to a point adjacent to said second supporting structure at which point said hanging means and therefore said stretcher can be removed from said first supporting structure, and mounted for sliding movement along the length of said second supporting structure.

15. The method of transferring an individual on a stretcher from a first hyperbaric chamber into a second hyperbaric chamber comprising the steps of coupling the access opening of a first hyperbaric chamber with the access aperture of a second hyperbaric chamber in a fluid tight relationship;

slidably hanging the stretcher on a supporting structure mounted within the second chamber, said supporting structure extending into said first chamber, the stretcher being hung to permit the stretcher to be in a substantially horizontal plane and to allow the stretcher to be slidable along the length of the supporting structure and through the aperture and opening; and sliding the stretcher with the individual thereon from the first chamber, through the aperture and opening into the second chamber.

16. The method of transferring an individual on a stretcher from a first hyperbaric chamber into a second hyperbaric chamber comprising the steps of coupling the access opening of a first hyperbaric chamber with the access aperture of a second hyperbaric chamber in a fluid tight relationship;

slidably hanging the stretcher on a first supporting structure transversely mounted within said first chamber substantially above said stretcher that does not obstruct the sides and undersides of said stretcher, the stretcher being hung to permit the stretcher to be in a substantially horizontal plane which passes through said opening and aperture and to allow the stretcher to be slidable along the first supporting structure;

sliding the stretcher along the first supporting structure to a point adjacent a second supporting structure transversely mounted within said second chamber substantially above said stretcher that does not obstruct the sides and undersides of said stretcher;

removing the stretcher from said first supporting structure;

hanging said stretcher on the second supporting structure to permit the stretcher to be in a substantially horizontal plane which passes through said opening and aperture and to allow the stretcher to be slidable along the second supporting structure; and sliding the stretcher along the second supporting structure to a point inside the second chamber.

* * * * *